US005236805A

United States Patent [19]

Idota et al.

[11] Patent Number: 5,236,805

[45] Date of Patent: Aug. 17, 1993

[54] METHOD OF FORMING IMAGES BY MEANS OF SILVER SALT DIFFUSION TRANSFER

[75] Inventors: Yoshio Idota; Osami Tanabe; Morio Yatihara, all of Kanagawa, Japan

[73] Assignee: Fuji Photo Film Co., Ltd., Kanagawa, Japan

[21] Appl. No.: 843,226

[22] Filed: Feb. 28, 1992

Related U.S. Application Data

[63] Continuation-in-part of Ser. No. 442,757, Nov. 29, 1989, abandoned.

[30] Foreign Application Priority Data

Nov. 29, 1988 [JP] Japan ..... 63-302044

[51] Int. Cl.[5] ..... G03C 5/54; G03C 1/34

[52] U.S. Cl. ..... 430/250; 430/230; 430/244; 430/614; 430/615

[58] Field of Search ..... 430/230, 233, 250, 251, 430/614, 615, 244

[56] References Cited

U.S. PATENT DOCUMENTS

| | | | |
|---|---|---|---|
| 4,514,488 | 4/1985 | Idota et al. | 430/250 |
| 4,654,297 | 3/1987 | Inoue | 430/230 |
| 4,659,646 | 4/1987 | Inoue | 430/230 |

*Primary Examiner*—Richard L. Schilling
*Attorney, Agent, or Firm*—Sughrue, Mion, Zinn, Macpeak & Seas

[57] ABSTRACT

A method of image formation by silver salt diffusion transfer in which a photosensitive element which contains an imagewise exposed photosensitive silver halide emulsion layer is developed, in the presence of a silver halide solvent, using an alkaline processing composition, in which at least a portion of the unexposed silver halide in the emulsion layer is converted to a transferable silver complex salt, and in which at least a portion of the silver complex salt is transferred into a silver precipitant containing image forming layer to form an image in the image receiving layer wherein a hydroxylamine developing agent is included in the processing composition and at least two stabilizing compounds having two different heterocyclic rings which are represented by the general formula (I) indicated below are included in the silver halide emulsion layer:

(I)

wherein Q represents a group of atoms which is required to form a five or six membered heterocyclic ring, and wherein the heterocyclic ring which is formed by Q is selected from a substituted or unsubstituted indazole ring, benzimidazole ring, benzotriazole ring, benzoxazole rings, benzothiazole ring, imidazole ring, thiazole ring, oxazole ring, triazole ring, tetrazole ring, triazaindene ring, tetraazaindene ring, pentaazaindene ring, pyrazole ring, indole ring, triazine ring, pyrimidine ring, pyridine ring and quinoline ring.

M represents a hydrogen atom, an alkali metal atom, a quaternary ammonium group, or a group such that M becomes a hydrogen atom or an alkali metal atom under alkaline conditions, and l represents 0 or 1.

9 Claims, No Drawings

METHOD OF FORMING IMAGES BY MEANS OF SILVER SALT DIFFUSION TRANSFER

CROSS-REFERENCE TO RELATED APPLICATION

This application is a continuation-in-part of application Ser. No. 07/442,757 filed on Nov. 29, 1989 now abandoned.

FIELD OF THE INVENTION

This invention relates to a method of forming images by means of silver salt diffusion transfer, and film units which are used therein.

BACKGROUND OF THE INVENTION

The method of forming images by diffusion transfer using silver salts such as silver halides is well known. In practice, this method involves, for example, processing a photosensitive silver halide emulsion which has been subjected to an imagewise exposure with an aqueous alkaline solution which contains a developing agent, a silver halide solvent and a film forming agent (viscosity increasing agent), reducing the exposed silver halide grains to silver by means of the developing agent, forming the residual unexposed silver halide into a transferable silver complex salt at the same time by means of the silver halide solvent, diffusing and transferring the silver complex salt by imbibition to a silver precipitant containing layer (image receiving layer) which is superimposed on the aforementioned emulsion layer and there reducing the silver complex salt with a developing agent with the assistance of the silver precipitant and forming a silver image.

In this method, use is made, for example, of a film unit wherein a photosensitive element in which a photosensitive silver halide emulsion layer is provided on an ordinary support and an image receiving element wherein an image receiving layer which contains a silver precipitant is provided on a support are combined with a processing element which contains an active alkaline aqueous solution which contains a developing agent, a silver halide solvent and a film forming agent.

First of all, after subjecting the emulsion layer of the photosensitive element to an imagewise exposure, the photosensitive element is superimposed on the image receiving element in such a way that the emulsion layer is facing the image receiving layer of the image receiving element, and the assembly is passed between a pair of rollers in such a way that the viscous aqueous alkaline solution of the processing element is spread between the two elements. Then, after the assembly has been left to stand for a prescribed period of time, the image receiving element is peeled away from the photosensitive element, whereupon a print, which has the prescribed image formed in the image receiving layer, is obtained.

Stabilization of photographic performance in respect of the storage of photographic products in which the silver salt diffusion transfer method is used is usually considered in terms of the image receiving element, the photosensitive element and the processing element individually, but depending on the formulation of the processing composition, photographic performance inevitably deteriorates during storage. On the other hand, although measures taken only in connection with the processing composition may provide stabilization under the highly alkaline conditions in which the chemical components are active, these measures may also have an effect not only on the photosensitive element but also on the image receiving element. Therefore, the problem cannot be resolved easily and further research work is required.

SUMMARY OF THE INVENTION

An object of the present invention is to provide a novel image forming method using silver salt diffusion transfer.

A further object of the present invention is to provide a method of stabilizing photographic performance during storage of products comprising image receiving elements, photosensitive elements and processing elements.

The aforementioned and other objects of the invention can be realized by means of a method of image formation by silver salt diffusion transfer in which a photosensitive element which contains an imagewise exposed photosensitive silver halide emulsion layer is developed, in the presence of a silver halide solvent, using an alkaline processing composition, in which at least a portion of the unexposed silver halide in the emulsion layer is converted to a transferable silver complex salt, and in which at least a portion of the silver complex salt is transferred into a silver precipitant-containing image forming layer to form an image in the image receiving layer wherein a hydroxylamine developing agent is included in the processing composition and at least two stabilizing compounds having two different heterocyclic rings, which are represented by the general formula (I) indicated below, are included in the silver halide emulsion layer:

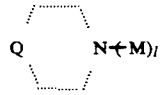

(I)

wherein Q represents a group of atoms which is required to form a five or six membered heterocyclic ring, and wherein the heterocyclic ring which is formed by Q is selected from a substituted or unsubstituted indazole ring, benzimidazole ring, benzotriazole ring, benzoxazole ring, benzothiazole ring, imidazole ring, thiazole ring, oxazole ring, triazole ring, tetrazole ring, triazaindene ring, tetraazaindene ring, pentaazaindene ring, pyrazole ring, indole ring, triazine ring, pyrimidine ring, pyridine ring and quinoline ring, M represents a hydrogen atom, an alkali metal atom, a quaternary ammonium group, or a group such that M becomes a hydrogen atom or an alkaline metal atom under alkaline conditions, and l represents 0 or 1.

DETAILED DESCRIPTION OF THE INVENTION

Actual heterocyclic rings which can be formed by Q include substituted or unsubstituted indazole rings, benzimidazole rings, benzotriazole rings, benzoxazole rings, benzothiazole rings, imidazole rings, thiazole rings, oxazole rings, triazole rings, tetrazole rings, triazaindene rings, tetraazaindene rings, pentaazaindene rings, pyrazole rings, indole rings, triazine rings, pyrimidine rings, pyridine rings and quinoline rings. In the present invention, any two different heterocyclic rings selected from the above rings can be used with each other.

These heterocyclic rings may be substituted with a nitro group, a halogen atom (for example, chlorine, bromide), a cyano group, a substituted or unsubstituted alkyl group (for example, methyl, ethyl, propyl, tert-butyl, cyanoethyl, methoxyethyl, methylthioethyl), an aryl group (for example, phenyl, 4-methanesulfonamidophenyl, 4-methylphenyl, 3,4-dichlorophenyl, naphthyl), an alkenyl group (for example, allyl), an aralkyl group (for example, benzyl, 4-methylbenzyl, phenethyl), an alkoxy group (for example, methoxy, ethoxy), an aryloxy group (for example phenoxy, 4-methoxyphenoxy), an alkylthio group (for example, methylthio, ethylthio, methoxyethylthio), an arylthio group (for example, phenylthio), sulfonyl groups (for example, methanesulfonyl, ethanesulfonyl, p-toluenesulfonyl), a carbamoyl group (for example, unsubstituted carbamoyl, methylcarbamoyl, phenylcarbamoyl), a sulfamoyl group (for example, unsubstituted sulfamoyl, methylsulfamoyl, phenylsulfamoyl), a carbonamido group (for example, acetamido, benzamido), a sulfonamido group (for example, methanesulfonamido, benzenesulfonamido, p-toluenesulfonamido), an acyloxy group (for example, acetyloxy, benzoyloxy), a sulfonyloxy group (for example, methanesulfonyloxy), a ureido group (for example, unsubstituted ureido, methyl ureido, ethyl ureido, phenylureido), a thioureido group (for example, unsubstituted thioureido, methylthioureido), an acyl group (for example, acetyl, benzoyl), a heterocyclic group (for example, 1-morpholino, 1-piperidino, 2-pyridyl, 4-pyridyl, 2-thienyl, 1-pyrazolyl, 1-imidazolyl, 2-tetrahydrofuryl, tetrahydrothienyl), an oxycarbonyl group (for example, methoxycarbonyl, phenoxycarbonyl), an oxycarbonylamino group (for example, methoxycarbonylamino, phenoxycarbonylamino, 2-ethylhexyloxycarbonylamino), an amino group (for example, unsubstituted amino, dimethylamino, methoxyethylamino, anilino), a carboxylic acid group and salts thereof, a sulfonic acid group and salts thereof, and a hydroxyl group.

M represents a hydrogen atom, an alkali metal atom (for example, sodium, lithium, potassium), a quaternary ammonium group (for example, trimethylammonium, dimethyl benzyl ammonium, tetrabutylammonium, tetramethylammonium), or a group such that M becomes a hydrogen atom or an alkali metal atom under alkaline conditions (for example, acetyl, cyanoethyl, methanesulfonyl).

Benzotriazoles, tetrazoles and azaindenes (specifically triazaindenes, tetraazaindenes and pentaazaindenes), for example, are preferred as the heterocyclic rings represented by general formula (I), and the use of at least one azaindene (triazaindene, tetraazaindene and pentaazaindene) is especially desirable.

Moreover, the conjoint use of a benzotriazole and an azaindene (triazaindene, tetraazaindene and pentaazaindene) is preferred.

The benzotriazoles may be substituted, and the aforementioned substituent groups for the heterocyclic groups can be cited as actual examples of such substituents groups.

The compounds which can be represented by the general formula disclosed in JP-B-50-33847 can be used as the azaindenes. (The term "JP-B" as used herein signifies an "examined Japanese patent publication".)

The compounds which can be represented by the general formula disclosed in JP-A-61-113238 can be used as benzotriazoles. (The term "JP-A" as used herein signifies an "unexamined published Japanese patent application".)

Actual examples of compounds which can be represented by general formula (I) are listed below as Compounds 1 to 50, but the invention is not limited to these examples.

1.
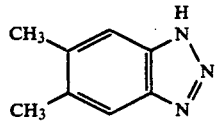

2.
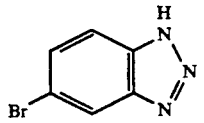

3.
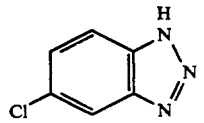

4.
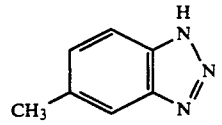

5.
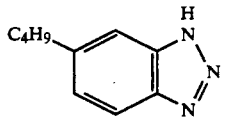

6.
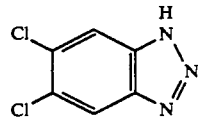

7.
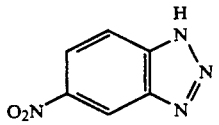

8.
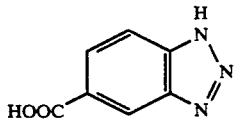

9.
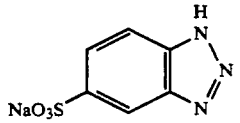

10.
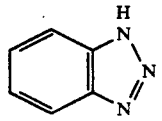

11.
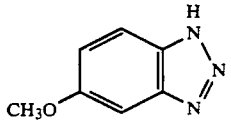

-continued
12.
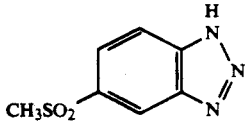
13.
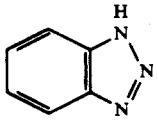
14.
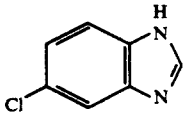
15.
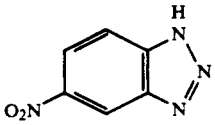
16.
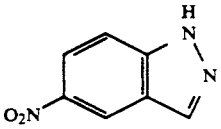
17.
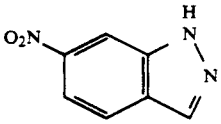
18.
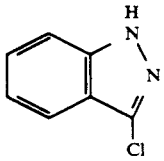
19.
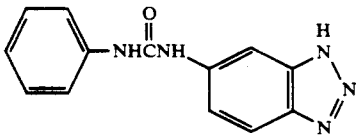
20.
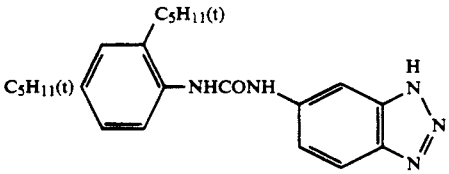
21.
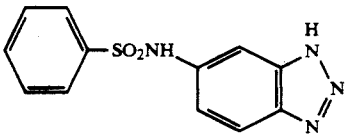
22.
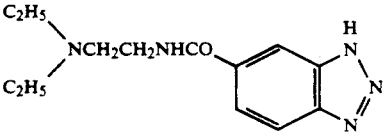
-continued
23.
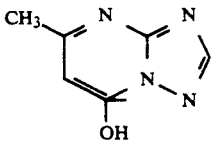
24.
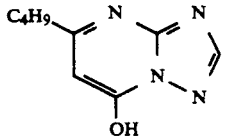
25.
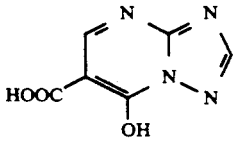
26.
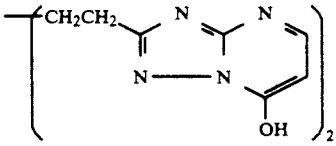
27.
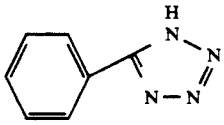
28.
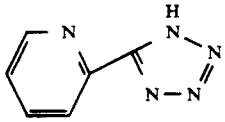
29.
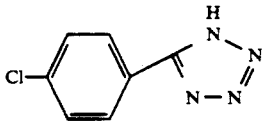
30.
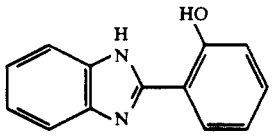
31.
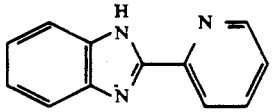
32.
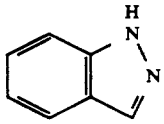
33.
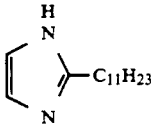

-continued

34.

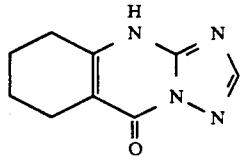

35.

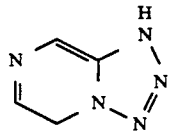

36.

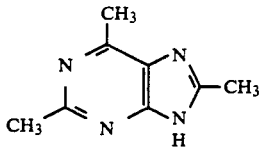

37.

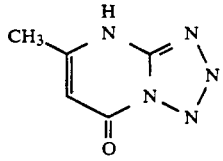

38.

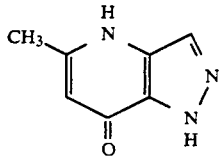

40.

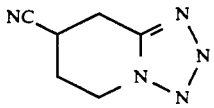

41.

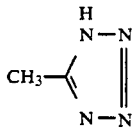

42.

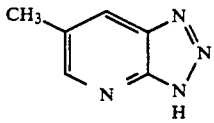

43.

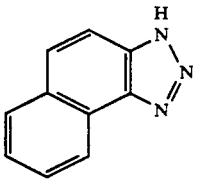

44.

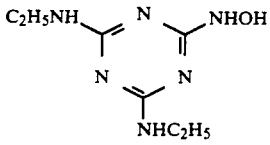

-continued

45.

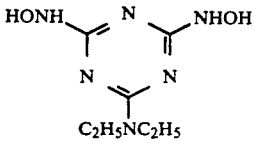

46.

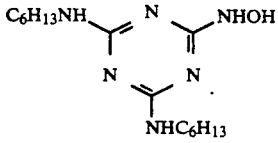

47.

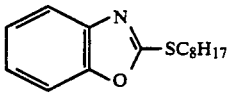

48.

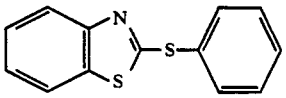

49.

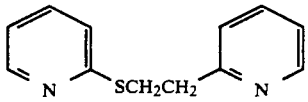

50.

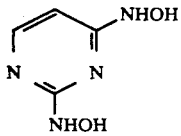

The compounds used in the present invention can be prepared using the methods disclosed in *Berichte der Deutschen Chemischen Gesellschaft,* 28 77 (1895), JP-A-50-37436, JP-A-51-3231, U.S. Pat. Nos. 3,295,976 and 3,376,310, Berichte der Deutschen *Chemischen Gesellschaft,* 22, 568 (1889), ibid. 29, 2483 (1896), *J. Chem. Soc.*. 1932, 1806, *J. Am. Chem. Soc.,* 71, 4000 (1949), U.S. Pat. Nos. 2,585,388 and 2,541,924, *Advances in Heterocyclic Chemistry,* 9, 165 (1968), *Organic Synthesis,* VI, 569 (1963), *J. Am. Chem. Soc.,* 45, 2390 (1923), *Chemische Berichte,* 9, 465 (1876), JP-B-40-28496, JP-A-50-89034, U.S. Pat. Nos. 3,106,467, 3,420,760, 2,271,229, 3,137,578, 3,148,066, 3,511,663, 3,060,028, 3,271,154, 3,251,691, 3,598,599 and 3,148,066, JP-B-43-4135, U.S. Pat. Nos. 3,615,616, 3,420,664, 3,071,465, 2,444,605, 2,444,606, 2,444,607 and 2,935,404, JP-A-57-202531, JP-A-57-167023, JP-A-57-164735, JP-A-60-80839, JP-A-57-14836, JP-A-60-130731, JP-A-58-159529, JP-A-59-159162, JP-A-60-217358, JP-A-61-80238, JP-B-60-29390, JP-B-60-29391, JP-B-60-133061 and JP-B-60-1431, U.S. Pat. Nos. 4,485,169, 4,680,257, 4,607,004, 4,448,878 and 4,458,010.

The compounds employed in the present invention form sparingly soluble compounds with silver ions, and their use in ordinary photographic systems as antifoggants is well known but, surprisingly, little information is available in connection with the combination of these compounds or analogous compounds with hydroxylamine developing agents as in the case of the present invention.

Mercaptoimidazole compounds have been disclosed as toners in JP-B-54-36495. Imidazolinethione compounds have been disclosed as toners in British Patent 1,409,844. N-methylmercaptoimidazoles and 2-acetamidomercaptothiadiazoles, for example, have been disclosed as image stabilizers for image receiving elements in JP-B-56-44418. The addition of 6-nitrobenzimidazole to processing fluid compositions has been disclosed in U.S. Pat. No. 3,293,034. Compounds such as azoles have been disclosed as general stabilizers in U.S. Pat. No. 4,654,297. Actual examples of these compounds include 1-phenyl-5-mercaptotetrazole and 4-hydroxy-6-methyl-1,3,3a,7-tetrazaindene. The conjoint use of the latter compound with α-lipoic acid is described in the illustrative examples.

Unexpectedly, the problems arising with processing compositions have been overcome by the conjoint use of additives for the silver halide emulsion layer as disclosed in the present invention as a result of a thorough investigation carried out with a view to minimizing the instability of photographic performance due to the inclusion in the processing composition of compounds which are comparatively unstable in respect of heat.

Furthermore, effective additives for providing stabilization during the preparation of the silver halide emulsion coating liquids and for the stabilization of photographic performance on storing the silver halide emulsion layers alone have also been discovered at the same time.

Toners such as tetrahydropyrimidinethione, developing agents such as hydroxylamine and phenidone compounds, and viscosity increasing agents such as hydroxyethylcellulose are examples of compounds which have a deleterious effect on the storage performance of processing compositions. The effect of toners which are added in small amounts is particularly great. Furthermore, compounds which affect the surface of the silver halide emulsion, for example, halides, especially iodides, have been shown to amplify these effects.

The term "stabilization of photographic performance" as used in connection with the present invention signifies the suppression of any changes in photographic performance, and principally, any loss of photographic speed, any lowering of maximum density and any softening of gradation.

In the preferred embodiments of the present invention, halides and especially iodides (for example, potassium iodide or sodium iodide) are included in the alkaline processing composition.

The amount of the compounds of general formula (I) added alone in the present invention is from 0.01 to 5 mmol, preferably from 0.05 to 1 mmol, per 100 grams of silver halide emulsion.

Furthermore, the two or more compounds of general formula (I), which are used in the present invention, may be added to the same or separate silver halide emulsion layer(s).

At least one type of silver halide emulsion is included in the silver halide emulsion layer.

The silver halide grains used in the invention are preferably silver iodobromide grains, silver chloroiodobromide grains or silver bromide grains, but grains which contain at least 1 mol % of silver iodide, and especially silver iodobromides, are most desirable.

The total thickness of the silver halide emulsion layer is preferably from 0.5 μm to 8.0 μm, and most desirably from 0.6 μm to 6.0 μm.

The total coated weight of silver halide grains, calculated as silver, is preferably from 0.1 to 3.0 g/m$^2$, and most desirably from 0.2 to 1.6 g/m$^2$.

The average grain size of the silver halide grains (the average based on projected areas, taking the diameters of the grains in the case of grains which are spherical or approximately spherical and the edge lengths in the case of cubic grains for the grain size) is preferably not more than 3 μm, and most desirably from 0.14 μm to 1.6 μm. The grain size distribution may be narrow or wide.

The silver halide grains in the silver halide emulsions may have a regular crystalline form, such as a cubic, octahedral, hexadecahedral or tetraicosahedral form, or an irregular crystalline form, such as a spherical or tabular form, or they may have a composite form consisting of these crystalline forms.

The silver halide grains may have a structure in which the interior and surface layers consist of different phases, or they may consist of a uniform phase. Furthermore, they may be grains of the type with which the latent image is formed principally on the surface of the grain, or of the type with which the latent image is formed principally within the grains, or they may be of the type with which the latent image is formed both at the surface and within the grains. The use of grains with which the latent image is formed principally at the surface of the grains is most desirable.

Compounds which can be represented by the general formula (II) indicated below are used for the hydroxylamine developing agents which are included in the processing composition.

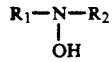

(II)

wherein $R_1$ represents an alkyl group, an alkoxyalkyl group or an alkoxyalkoxyalkyl group, and $R_2$ represents a hydrogen atom, an alkyl group, an alkoxyalkyl group, an alkoxyalkoxyalkyl group or an alkenyl group. The number of carbon atoms in each of $R_1$ and $R_2$ is preferably from 2 to 10, more preferably 2 to 5, and most preferably 2 to 4.

N,N-Diethylhydroxylamine and N,N-dimethoxyethylhydroxylamine are especially desirable.

The amount of developing agent added is preferably from 0.1 to 40 grains, and most desirably from 1 to 20 grams, per 100 grams of processing composition.

The use of a photosensitive element in which a photosensitive silver halide emulsion layer and an overlying protective layer are established on one side of a support comprising a poly(ethylene terephthalate) film which contains titanium dioxide or carbon black and which has an under-layer on both sides, and in which a carbon black layer and an overlying protective layer are provided on the other side is preferred in the present invention.

The use of photosensitive elements which have a titanium dioxide layer, an overlying photosensitive silver halide emulsion layer and then an overlying protective layer on one side of a support comprising a poly(ethylene terephthalate) film which contains titanium dioxide or carbon black and which has an underlayer on both sides, and in which a carbon black layer and an overlying protective layer are provided on the other side of the support rather than the layer structure described above is also desirable. Furthermore, colored dyes can also be used in place of, or in addition to, the carbon black referred to above. Furthermore, in those cases in which carbon black and/or colored dyes are included in poly(ethylene terephthalate), a layer of carbon black and/or colored dye need not be provided on the surface. Furthermore, the titanium dioxide referred to above can be replaced by other white pigments.

Polyethylene laminated papers, baryta papers and cellulose triacetate can be used as supports instead of the above mentioned polyester compounds.

Hydrophilic binders, such as, for example, gelatin, are included in the above mentioned photosensitive silver halide layers, protective layers, carbon black layers, etc.

Furthermore, the photosensitive elements used in the present invention can be spectrally sensitized with, for example, a methine dye. The sensitizing dyes which can be used for this purpose are preferably cyanine dyes, merocyanine dyes, complex cyanine dyes, complex merocyanine dyes, holopolor cyanine dyes, hemi-cyanine dyes, styryl dyes, and hemioxonol dyes. The cyanine dyes, merocyanine dyes and complex merocyanine dyes are especially useful dyes in this connection. Furthermore, combinations of sensitizing dyes such as those disclosed in U.S. Pat. No. 4,555,482 and JP-A-61-163334 can be used for this purpose.

Inorganic or organic film hardening agents can be included in the photosensitive elements of the present invention. For example, a chromium salt (for example, chrome alum, chromium acetate), an aldehyde (for example, formaldehyde, glyoxal, glutaraldehyde), an N-methylol compound (for example, dimethylolurea, methyloldimethylhydantoin), a dioxane derivative (for example, 2,3-dihydroxydioxane), an active vinyl compound (for example, 1,3,5-triacryloyl-hexahydro-s-triazine) and a mucohalogen acid (for example, mucochloric acid, mucophenoxychloric acid), can be used individually or in combination for this purpose.

Surfactants can be used as coating aids in the silver halide emulsion layers and other hydrophilic colloid layers of the photosensitive elements of the present invention. The compounds disclosed in the section entitled "Coating Aids" on page 26 of *Research Disclosure* volume 176, No. 17643 (December 1978) and the compounds disclosed in JP-A-61-20035 can be used as coating aids.

Compounds such as, for example, polyalkyleneoxides and the ether, ester and amine derivatives thereof, thioether compounds, thiomorpholines, quaternary ammonium compounds, urethane derivatives, urea derivatives, imidazole derivatives and 3-pyrazolidones can be included in the silver halide emulsion layers and other hydrophilic colloid layers of the photosensitive elements of the present invention with a view to increasing photographic speed, increasing contrast or accelerating development. The compounds disclosed, for example, in U.S. Pat. Nos. 2,400,532, 2,423,549, 2,716,062, 3,617,280, 3,772,021 and 3,808,003 can be used as compounds of this type.

Dispersions of water insoluble or sparingly soluble synthetic polymers can be included in the silver halide emulsion layers and other hydrophilic layers of the photosensitive elements of the present invention with a view to improving dimensional stability. For example, polymers comprised of alkyl (meth)acrylates, alkoxyalkyl (meth)acrylates, glycidyl(meth)acrylamide, (meth-)acrylamide, vinyl ester (for example, vinyl acetate), acrylonitrile, olefins or styrene, either individually or in combination, or polymers in which combinations of these components with, for example, acrylic acid, methacrylic acid, $\alpha,\beta$-unsaturated carboxylic acids, hydroxalkyl (meth)acrylates and styrenesulfonic acid, as monomer components, can be used for this purpose.

Protective layers can be provided on the silver halide emulsion layers which are used in the photosensitive elements of the present invention. The protective layers comprise a hydrophilic polymer such as gelatin, and slip agents of matting agents, such as, for example, poly(-methyl methacrylate) latex or silica, as disclosed in JP-A-61-47946 and JP-A-61-75338 can be included in these protective layers.

Dyes such as filter dyes or anti-irradiation dyes, and ultraviolet absorbers can also be included in the photosensitive silver halide emulsion layers and other hydrophilic colloid layers in the photosensitive elements of the present invention.

Antistatic agents, plasticizers and anti-aerial fogging agents can also be included in the photosensitive elements of the present invention.

The structure of the photosensitive elements of the invention may include just the photosensitive element, or a photosensitive element and an image receiving element may be provided on the same support, but individual photosensitive elements are preferred.

The material used for processing may be present in the photosensitive element or in a processing composition. A processing element is comprised of developing agent, silver halide solvent and alkali, and it can also contain viscosity increasing agents, anti-foggants, toners, stabilizers, image stabilizers and release improving agents.

The alkyl substituted aminophenols and 1-aryl-3-pyrazolidinone compound developing agents disclosed in JP-B-49-13580 can be used conjointly with the above mentioned hydroxylamine developing agents.

The silver halide solvents can be included in the processing elements, in the photosensitive element and/or in the image receiving element. Inclusion in the processing element is preferred. The cyclic compounds disclosed in U.S. Pat. Nos. 2,857,274, 2,857,275 and 2,857,276 are appropriate, and of these materials the use of uracil and 6-methyluracil, for example, is preferred.

Moreover, alkali metal thiosulfates, especially sodium and potassium salts, are preferred. Silver halide solvents can also be selected from among the disulfonylmethane compounds disclosed in U.S. Pat. Nos. 3,958,992, 3,976,647, 4,009,167, 4,032,538, 4,046,568, 4,047,954, 4,047,955 and 4,107,176, and JP-A-47-330, the dihydroxypyrimidine compounds which have thioether groups disclosed in U.S. Pat. Nos. 4,126,459, 4,150,228, 4,211,559 and 4,211,562, and the aminothioethers disclosed in U.S. Pat. Nos. 4,251,617, 4,267,254 and 4,267,256. These compounds can be used individually, or a plurality of these compounds can be used, and the conjoint use of two or more silver halide solvents, especially a cyclic imido compound and a dihydroxypyrimidine which has a thioether group, is advantageous in that there is no precipitation of white crystals on the surface of prints even when they are stored for long periods of time.

The amount of silver halide solvent added is preferably from 0.1 to 30 grams, and most desirably from 0.5 to 10 grains, per 100 grams of alkali processing composition.

Alkali hydroxides (for example, sodium hydroxide, potassium hydroxide or lithium hydroxide), phosphates and carbonates can be used as the alkali. The use of potassium hydroxide is preferred.

In those cases where the processing fluid is spread in the form of a thin layer between an image receiving element and a superimposed photosensitive element, it preferably contains a polymeric film forming agent, concentrating agent or a viscosity increasing agent. Hydroxyethylcellulose and sodium carboxymethylcellulose are especially useful for this purpose, and they can be included in the processing fluid at a concentration which is effective for providing an appropriate viscosity in accordance with the known principles of the diffusion transfer method.

Moreover, other auxiliary agents the use of which is known in the silver salt diffusion transfer method, for example, antifoggants, toners, stabilizers, image stabilizers and agents for improving release properties, can also be included in the processing fluid. In particular, tetrahydropyrimidinethione, 2,4-dimercaptopyrimidine and 3-(5-mercaptotetrazolyl)sulfonates can be included as toners and 1-phenyl-2-mercaptoimidazole can be included as a stabilizer. Furthermore, the inclusion of oxyethylamino compounds, for example, triethanolamine, is useful for increasing the storage life expectancy of the processing fluid, as disclosed in U.S. Pat. No. 3,619,185. Furthermore, organic phosphonic acid compounds, such as 1-hydroxyethylidene-1,1-phosphonic acid, can be used as image stabilizing agents. Furthermore, zinc compounds, such as, for example, zinc oxide, zinc acetate and zinc nitrate for example, can be used as agents for improving the release properties. Furthermore, iodides can be used as toe gradation controlling agents.

White pigments (for example, titanium dioxide, silicon dioxide, kaolin) and black pigments (for example, carbon black or black organic pigments) can be used as light shielding agents which are added to the processing fluid.

The processing fluids such as those described above are preferably housed in a breakable container to form a processing element. Any of the known breakable containers and materials can be used, and these have been described in detail in, for example, U.S. Pat. Nos. 3,056,491, 3,056,492, 3,173,580, 3,750,907, 3,833,831, 4,303,750 and 4,303,751.

The image receiving element in the present invention has an image receiving layer which contains a silver precipitant coated on a support. The support can be made, for example, from a baryta paper, cellulose triacetate or a polyester compound. The image receiving layers are preferably formed by covering a support which has an underlayer, as required, with a covering liquid of an appropriate cellulose ester, for example, cellulose diacetate, in which a silver precipitant has been dispersed. The cellulose ester layer obtained in this way is then subjected to alkaline hydrolysis and converted to cellulose for at least part of its thickness. In an especially useful practical example, one or more mercapto compounds which are suitable for improving the tone and stability of the silver transfer image or for improving other photographic performance are included in the silver precipitant layer and/or the part of the cellulose ester layer which has not been subjected to hydrolysis, for example the part of a cellulose ester layer which contains cellulose diacetate which has not been hydrolyzed. The mercapto compounds can diffuse from the location in which they are initially located for use during imbibition. Such image receiving elements of this type have been disclosed in, for example, U.S. Pat. No. 3,607,269.

The compounds disclosed in JP-A-49-120634, JP-B-56-4418, British Patent 1,276,961, JP-B-56-21140, JP-A-59-231537 and U.S. Pat. No. 4,569,899 are preferred for the mercapto compounds.

Heavy metals, for example, lead, zinc, nickel, cadmium, tin, chromium, copper and cobalt, and especially precious metals, for example, gold, silver, platinum and palladium, are actual examples of silver precipitants. Other useful silver precipitants include the sulfides and selenides of heavy metals and precious metals, and especially the sulfides of mercury, copper, aluminum, zinc, cadmium, cobalt, nickel, silver, lead, antimony, bismuth, cerium, magnesium, gold, platinum and palladium, and the selenides of lead, zinc, antimony and nickel. Of these materials, the use of gold, platinum, palladium and their sulfides is especially desirable.

Furthermore, an acidic polymer layer (alkali neutralizing layer) for neutralization purposes is preferably provided between the said unsaponified layer (unhydrolized part of the cellulose ester layer) (timing layer) and the support.

The polymeric acids disclosed in JP-B-48-33697 can be used, for example, in the alkali neutralizing layers used in the present invention. The preferred polymeric acids include copolymers of maleic anhydride, such as styrene/maleic anhydride copolymers, methyl vinyl ether/maleic anhydride copolymers and ethylene/maleic anhydride copolymers, for example, and (meth)acrylic acid (co)polymers, such as acrylic acid/alkyl acrylate copolymers, acrylic acid/alkyl methacrylate copolymers, methacrylic acid/alkyl acrylate copolymers and methacrylic acid/alkyl methacrylate copolymers.

Polymers which contain sulfonic acid groups, such as poly(styrenesulfonic acid) and benzaldehydesulfonic acid, and poly(vinyl alcohol) acetals are also useful polymeric acids.

Furthermore, the mercapto compounds which can be used in the timing layers can also be used in the neutralizing layers. Furthermore, mixtures of hydrolyzable alkali impermeable polymers (the aforementioned cellulose esters are preferred) or alkali permeable polymers may be mixed with these polymeric acids in order to improve the physical properties of the film.

Furthermore, the presence of an image stabilizing layer in the image receiving sheet is desirable for improving image storage properties. Cationic polymeric electrolytes are preferred for these stabilizers, and the use of the water dispersed latexes disclosed in JP-A-59-1666940, U.S. Pat. Nos. 3,958,995, and 4,131,469, JP-A-55-142339, JP-A-54-126027, JP-A-54-155835, and JP-A-54-92274, the polyvinylpyridinium salts disclosed in U.S. Pat. Nos. 2,548,564, 3,148,016 and 3,756,814, the water soluble quaternary ammonium salt polymers disclosed in U.S. Pat. No. 3,709,690, and the water insoluble quaternary ammonium salt polymers disclosed in U.S. Pat. No. 3,898,088 is preferred as the cationic polymeric electrolyte.

Furthermore, cellulose acetate is preferred as the binder for the image stabilizing layer, and the use of a cellulose diacetate of which the degree of acetylation is from 40 to 49% is especially desirable. The image stabilizing layer is preferably provided between the aforementioned neutralizing layer and the aforementioned timing layer.

Furthermore, acid polymers (for example, methyl vinyl ether/maleic anhydride copolymers and methyl vinyl ether/maleic anhydride half ester copolymers) can be included in the timing layer to prevent any increase or decrease of the timing time due to changes in the cellulose ester during long term storage.

Moreover, white pigments (for example, titanium dioxide, silicon dioxide, kaolin, zinc oxide, barium sulfate) can also be included in the timing layer and neutralizing layer in order to prevent the permeation of light into the sheet from the cross section (light piping).

Furthermore, intermediate layers may also be established between the image receiving layer and the timing layer. The use of hydrophilic polymers, such as gum arabic, poly(vinyl alcohol) and polyacrylamide, for example, is preferred for the intermediate layer.

Furthermore, the provision of a peeling layer on the surface of the image receiving layer is desirable for preventing the processing fluid from becoming attached to the image receiving layer on peeling apart after spreading the processing fluid. The preferred peeling layers are formed with gum arabic, hydroxyethylcellulose, methylcellulose, poly(vinyl alcohol), polyacrylamide or sodium alginate, or take the form of those disclosed in U.S. Pat. Nos. 3,772,024, 3,820,999 and British Patent 1,360,653.

Methods by which light shielding agents (for example, carbon black or black organic pigments) are included in the paper of the support, and methods by which the above mentioned light shielding agents are coated on the reverse side of the support, can be used for light shielding purposes. Moreover, white pigments (for example, titanium dioxide, silicon dioxide, kaolin, zinc oxide or barium sulfate) are preferably coated in order to whiten the reverse side of a support which has been blackened with a light shielding agent.

Furthermore, moisture absorbing agents such as glycerine and film improving agent such as poly(ethyl acrylate latex) can be included in order to provide an improvement in respect of curling and brittleness.

Furthermore, a protective layer can be provided as the uppermost of these layers. Matting agents may be included in such a protective layer in order to improve the adhesion properties and to make the surface suitable for writing upon.

Gelatin, cellulose esters or poly(vinyl alcohol), for example, can be used as a binder for these layers.

The invention is described in more detail below by means of illustrative examples and comparative examples, but the invention is not limited thereto.

ILLUSTRATIVE EXAMPLES 1 TO 18

1. Preparation of the Image Receiving Sheet

The following layers were established sequentially on a polyethylene laminated paper support to form an image receiving sheet. The numerical values in parenthesis indicate the coated weights in units of g/m$^2$.

(1) Neutralizing Layer

Cellulose acetate (55% acetylation) (6), methyl vinyl ether/maleic anhydride copolymer (4), the compound indicated below (0.04), 1-(4-hexylcarbamoylphenyl)-2,3-dihydroxyimidazole-2-thione (0.25)

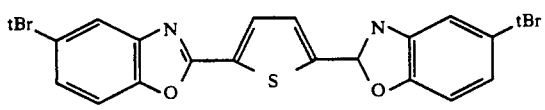

(2) Image Stabilizing Layer

Cellulose acetate (46% acetylated) (4), the compound indicated below (2)

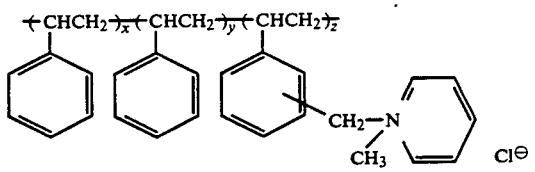

x:y:z = 5:47.5:47.5

(3) Timing Layer

Cellulose acetate (55% acetylation) (8)

(4) Image Receiving Layer

Cellulose acetate (55% acetylated) (2), palladium sulfide ($7.5\times10^{-4}$), 1-(4-hexylcarbamoylphenyl)-2,3-dihydroimidazole-2-thione ($1.0\times10^{-2}$)

(5) Saconification

The surface of the image receiving layer was saponified with a liquid mixture comprising 12 grains of sodium hydroxide, 24 grams of glycerine and 280 ml of methanol and washed with water.

(6) Peeling Layer

Butyl methacrylate/acrylic acid copolymer (mol ratio 15:85) (0.1)

(7) Backing Layer

A light shielding layer, a white layer and a protective layer were coated onto the reverse side of the above mentioned support.

(7-1) Light Shielding Layer

Carbon black (4), gelatin (8), Spherical poly(ethyl acrylate) particles (average particle size 0.05 μm) (2)

(7-2) White Layer

Titanium dioxide (6), gelatin (0.7)

(7-3) Protective Layer

Poly(ethyl methacrylate) (average particle size 2.5 μm) (0.2), Gelatin (1.6)

2. Preparation of the Photosensitive Sheet

Each of the following layers was coated onto a support (poly(ethylene terephthalate)) to prepare a photosensitive sheet. The numerical values in parenthesis indicate the coated weights in units of g/m$^2$.

(1) Photosensitive Layer a) Silver halide emulsion comprised of silver iodobromide of average grain size 1.1 μm (silver iodide content 3.7 mol %) (calculated as silver: 0.3) and silver iodobromide of average grain size 0.6 μm (silver iodide content 3.0 mol %) (calculated as silver: 0.3):

b) Two compounds of general formula (I): with each of the two compounds being added at a rate of 0.5 mmol per 100 grams in the silver halide emulsion.

Example (1): Cpds. 2 and 23 Benzotriazole and Tetraazaindene

Example (2): Cpds. 3 and 23 Benzotriazole and Tetraazaindene
Example (3): Cpds. 3 and 24 Benzotriazole and Tetraazaindene
Example (4): Cpds. 3 and 29 Benzotriazole and Tetrazole
Example (5): Cpds. 4 and 30 Benzotriazole and Benzimidazole
Example (6): Cpds. 7 and 23 Benzotriazole and Tetraazaindene
Example (7): Cpds. 23 and 32 Tetraazaindene and Indazole
Example (8): Cpds. 23 and 44 Tetraazaindene and Triazine
Example (9): Cpds. 23 and 29 Tetraazaindene and Tetrazole
Example (10): Cpds. 23 and 30 Tetraazaindene and Benzimidazole
Example (11): Cpds. 23 and 47 Tetraazaindene and Benzoxazole
Example (12): Cpds. 23 and 48 Tetraazaindene and Thiazole
Example (13): Cpds. 4 and 28 Benzotriazole and Tetrazole
Example (14): Cpds. 4 and 32 Benzotriazole and Indazole
Example (15): Cpds. 4 and 36 Benzotriazole and Tetraazaindene
Example (16): Cpds. 23 and 38 Tetraazaindene and Triazaindene
Example (17): Cpds. 23 and 35 Tetraazaindene and Pentaazaindene
Example (18): Cpds. 23 and 50 Tetraazaindene and Pyrimidine c) The sensitizing dyes indicated below (0.04 of each)

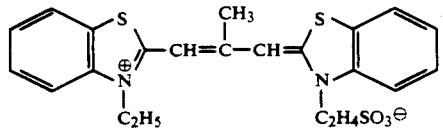

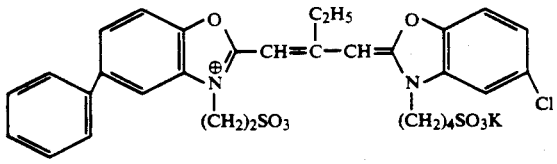

(2) Protective Layer

Gelatin (0.7), Poly(methyl methacrylate) particles (0.1)

(3) Backing Layers (3-1) Light Shielding Layer

Carbon black (4), Gelatin (2)

(3-2)Protective Layer

Gelatin (0.7), Poly(methyl methacrylate) particles (0.1)

3. Preparation of the Processing Fluid

The processing fluid is prepared under a blanket of nitrogen to prevent air oxidation.

| | |
|---|---|
| Titanium dioxide | 5 grams |
| Potassium hydroxide | 280 grams |
| Uracil | 90 grams |
| Tetrahydropyrimidinethione | 0.2 gram |
| 1-Phenyl-2-mercaptoimidazole | 0.2 gram |
| Potassium iodide | 0.2 gram |
| Zinc nitrate, nona-hydrate | 40 grams |
| Triethanolamine | 6 grams |
| 1-Hydroxyethylidene-1,1-phosphonic acid (60% aqueous solution) | 15 grams |
| Hydroxyethylcellulose | 45 grams |
| N,N-Dimethoxyethylhydroxylamine (17% aqueous solution) | 220 grams |
| 4-Methyl-4-hydroxymethyl-1-phenyl-3-pyrazolidinone | 1.5 grams |
| Water | 1300 ml |

COMPARATIVE EXAMPLES 1 TO 34

The same Image Receiving Sheet and Photosensitive Sheet as in Illustrative Examples 1 to 18 were prepared, except that the photosensitive layer in the Photosensitive Sheet was changed to contain a single compound of general formula (I) in an amount of 0.5 mmol per 100 gram in total of silver halide emulsion.

The single compounds are shown below, it being noted that Comparative Examples (11), (12), (16) to (25) and (27) to (30) employed the single compounds at a rate of 1 mmol per 100 grams of silver halide emulsion, and Comparative Example 13 employed the two compounds shown below at the rates shown below per 100 grams in total of silver halide emulsion.

Comparative Example (1): Compound 2 Benzotriazole
Comparative Example (2): Compound 3 Benzotriazole
Comparative Example (3): Compound 4 Benzotriazole
Comparative Example (4): Compound 7 Benzotriazole
Comparative Example (5): Compound 23 Tetraazaindene
Comparative Example (6): Compound 24 Tetraazaindene
Comparative Example (7): Compound 29 Tetrazole
Comparative Example (8): Compound 30 Benzimidazole
Comparative Example (9): Compound 32 Indazole
Comparative Example (10): Compound 44 Triazine
Comparative Example (11): Compound 3 Benzotriazole
Comparative Example (12): Compound 23 Tetraazaindene
Comparative Example (13): Compound 23 (0.66 mol) Tetraazaindene and α-lipoic acid (0.05 mmol)
Comparative Example (14): α-Lipoic acid
Comparative Example (15): 1-Phenyl-5-mercapto tetrazole
Comparative Example (16): Compound 28 Tetrazole
Comparative Example (17): Compound 36 Tetraazaindene
Comparative Example (18): Compound 47 Benzoxazole
Comparative Example (19): Compound 48 Thiazole
Comparative Example (20): Compound 4 Benzotriazole
Comparative Example (21): Compound 29 Tetrazole
Comparative Example (22): Compound 30 Benzimidazole
Comparative Example (23): Compound 32 Indazole
Comparative Example (24): Compound 38 Triazaindene
Comparative Example (25): Compound 35 Pentaazaindene
Comparative Example (26): Compound 50 Pyrimidine
Comparative Example (27): Compound 2 Benzotriazole Comparative Example (28): Compound 7 Benzotriazole
Comparative Example (29): Compound 24 Tetrazaindene
Comparative Example (30): Compound 44 Triazine
Comparative Example (31): Compound 28 Tetrazole
Comparative Example (32): Compound 36 Tetraazaindene
Comparative Example (33): Compound 47 Benzoxazole In a first set of tests, the image receiving sheets, photosensitive sheets and processing fluids were combined fresh, the fresh photosensitive sheets were exposed, and the processing fluid was spread out and processing was carried out. The spreading and peeling conditions were 25° C., 30 seconds.

In a second set of tests, the image receiving sheets and photosensitive sheets were stored for 7 days under conditions of 50° C. and 50% (relative humidity), and the processing fluid was stored for 7 days at 50° C. After the seven day storage, the photosensitive sheets were exposed and processed as above.

The photographic speed was determined as the exposure required to provide a density of 0.6.

The changes which occurred between the first set of tests and second set of tests in photographic performance on storage are shown in Table 1. The relative speeds and maximum densities shown in Table 1 for the illustrative examples of the present invention show no significant difference from those of the fresh photographs. In the Control Comparative Example in Table 1, no compounds of general formula (I) were added to the photosensitive layers. As can be seen from Table 1, the relative speed for the Comparative Examples showed significant differences, and the Control Test showed a pronounced fall in maximum density.

TABLE 1

| | Relative Speed | Maximum Density |
|---|---|---|
| | Example of The Invention | |
| (1) | −0.05 | −0.03 |
| (2) | −0.04 | −0.02 |
| (3) | −0.06 | −0.02 |
| (4) | −0.08 | −0.03 |
| (5) | −0.06 | −0.05 |
| (6) | −0.07 | −0.03 |
| (7) | −0.08 | −0.03 |
| (8) | −0.08 | −0.04 |
| (9) | −0.06 | −0.04 |
| (10) | −0.04 | −0.05 |
| (11) | −0.07 | −0.04 |
| (12) | −0.07 | −0.04 |
| (13) | −0.07 | −0.04 |
| (14) | −0.06 | −0.05 |
| (15) | −0.08 | −0.03 |
| | Comparative Example | |
| Control | −0.19 | −0.20 |
| (1) | −0.15 | −0.02 |
| (2) | −0.12 | −0.01 |
| (3) | −0.15 | −0.02 |
| (4) | −0.15 | −0.02 |
| (5) | −0.12 | −0.02 |
| (6) | −0.15 | −0.02 |
| (7) | −0.18 | −0.02 |
| (8) | −0.19 | −0.03 |
| (9) | −0.18 | −0.03 |
| (10) | −0.17 | −0.02 |
| (11) | −0.12 | −0.02 |
| (12) | −0.14 | −0.02 |
| (13) | −0.14 | −0.03 |
| (14) | −0.20 | −0.06 |
| (15) | — | — |
| (16) | −0.16 | −0.02 |
| (17) | −0.12 | −0.05 |
| (18) | −0.10 | −0.10 |
| (19) | too low to measure | |
| (20) | −0.13 | −0.08 |
| (21) | −0.12 | −0.02 |
| (22) | −0.12 | −0.01 |
| (23) | −0.13 | −0.13 |
| (24) | −0.15 | −0.03 |
| (25) | −0.12 | −0.02 |
| (26) | −0.17 | −0.03 |
| (27) | −0.13 | −0.02 |
| (28) | −0.23 | —* |
| (29) | −0.16 | −0.02 |
| (30) | −0.15 | −0.02 |
| (31) | −0.17 | −0.10 |
| (32) | −0.15 | −0.07 |
| (33) | −0.18 | −0.05 |

Comparative Example 15: No comparison could be made because the maximum density was low (less than 0.6).

Another series of tests were performed in which just the processing was stored. The photographic performance on storing just the processing fluid was a relative speed of −0.10 and maximum density of +0.01 with both the Illustrative Examples and Comparative Examples. No comparison could be made with Comparative Example 15 because the maximum density was low (less than 0.6).

Still another series of tests were performed in which just the photosensitive layer was stored. The change in photographic performance on storing just the photosensitive layer was good with both the Illustrative Examples and Comparative Examples. However, the control test showed a pronounced fall in maximum density. Furthermore, with Comparative Example 15 the fresh photographic performance gave a very low maximum density and no comparison could be made.

In a still further series of tests, when the silver halide emulsion coating liquid was stored for 12 hours at 40° C. during the manufacturing process, the change in photographic performance was good with both the Illustrative Examples and the Comparative Examples. However, the control test showed a pronounced fall in maximum density. Furthermore, with Comparative Example 15, the fresh photographic performance gave a very low maximum density and no comparison could be made.

Structures within the scope of this present invention are such that there is essentially no fall in the maximum density ($D_{max}$) and little loss of photographic speed during storage. Furthermore, with silver halide emulsion coating liquids which contain at least two compounds of the present invention, there is essentially no change in photographic performance and, more precisely, essentially no loss of photographic speed, on ageing during the manufacturing process.

While the invention has been described in detail and with reference to specific embodiments thereof, it will be apparent to one skilled in the art that various changes and modification can be made therein without departing from the spirit and scope of the invention.

What is claimed is:

1. A method of image formation by silver salt diffusion transfer wherein a photosensitive element which contains an imagewise exposed photosensitive silver halide emulsion layer is developed, in the presence of a silver halide solvent, using an alkaline processing composition, wherein at least a portion of the unexposed silver halide in the emulsion layer is converted to a transferable silver complex salt, and wherein at least a portion of the silver complex salt is transferred into a silver precipitant containing image forming layer to form an image in the image receiving layer wherein a hydroxylamine developing agent is included in the processing composition and at least two stabilizing compounds having two different heterocyclic rings which are represented by the general formula (I) indicated below are included in the silver halide emulsion layer;

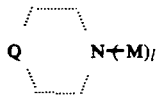

(I)

wherein Q represents a group of atoms which is required to form a five or six membered heterocyclic ring M represents a hydrogen atom, an alkali metal atom, a quaternary ammonium group, or a group such that M becomes a hydrogen atom or an alkali metal atom under alkaline conditions, and l represents 0 or 1, wherein the two different heterocyclic rings are selected from the group consisting of a benzotriazole, a tetraazaindene and a tetrazole.

2. The method according to claim 1, wherein the two different heterocyclic rings are a benzotriazole and a tetraazaindene.

3. The method according to claim 1, wherein the two different heterocyclic rings are a benzotriazole and a tetrazole.

4. A method of image formation by silver salt diffusion transfer wherein a photosensitive element which contains an imagewise exposed photosensitive silver halide emulsion layer is developed, in the presence of a silver halide solvent, using an alkaline processing composition, wherein at least a portion of the unexposed silver halide in the emulsion layer is converted to a transferable silver complex salt, and wherein at least a portion of the silver complex salt is transferred into a silver precipitant containing image forming layer to form an image in the image receiving layer wherein a hydroxylamine developing agent is included in the processing composition and at least two stabilizing compounds having two different heterocyclic rings which are represented by the general formula (I) indicated below are included in the silver halide emulsion layer:

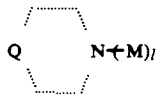

(I)

wherein Q represents a group of atoms which is required to form a five or six membered heterocyclic ring M represents a hydrogen atoms, an alkali metal atom, a quaternary ammonium group, or a group such that M becomes a hydrogen atom or an alkali metal atom under alkaline conditions, and l represents 0 or 1, wherein one of the two different heterocyclic rings is selected from the group consisting of a tetraazaindene and a benzotriazole and the other heterocyclic ring is selected from the group consisting of a benzimidazole, imidazole and an indazole.

5. The method according to claim 4, wherein the two different heterocyclic rings are a benzotriazole and an imidazole.

6. A method of image formation by silver salt diffusion transfer wherein a photosensitive element which contains an imagewise exposed photosensitive silver halide emulsion layer is developed, in the presence of a silver halide solvent, using an alkaline processing composition, wherein at least a portion of the unexposed silver halide in the emulsion layer is converted to a transferable silver complex salt, and wherein at least a portion of the silver complex salt is transferred into a silver precipitant containing image forming layer to form an image in the image receiving layer wherein a hydroxylamine developing agent is included in the processing composition and at least two stabilizing compounds having two different heterocyclic rings which are represented by the general formula (I) indicated below are included in the silver halide emulsion layer:

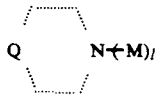

(I)

wherein Q represents a group of atoms which is required to form a five or six membered heterocyclic ring M represents a hydrogen atom, an alkali metal atom, a quaternary ammonium group, or a group such that M becomes a hydrogen atom or an alkali metal atom under alkaline conditions, and l represents 0 or 1, wherein the two different heterocyclic rings are a benzotriazole and a heterocyclic ring selected from the group consisting of a triazaindene, a tetraazaindene and a pentaazaindene.

7. A method of image formation by silver salt diffusion transfer wherein a photosensitive element which contains an imagewise exposed photosensitive silver halide emulsion layer is developed, in the presence of a silver halide solvent, using an alkaline processing composition, wherein at least a portion of the unexposed silver halide in the emulsion layer is converted to a transferable silver complex salt, and wherein at least a portion of the silver complex salt is transferred into a silver precipitant containing image forming layer to form an image in the image receiving layer wherein a hydroxylamine developing agent is included in the processing composition and at least two stabilizing compounds having two different heterocyclic rings which are represented by the general formula (I) indicated below are included in the silver halide emulsion layer:

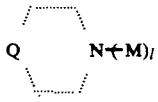

(I)

wherein Q represents a group of atoms which is required to form a five or six membered heterocyclic ring M represents a hydrogen atom, an alkali metal atom, a quaternary ammonium group, or a group such that M becomes a hydrogen atom or an alkali metal atom under alkaline conditions, and l represents 0 or 1, wherein one of the two different heterocyclic rings is a tetraazaindene and the other heterocyclic ring is selected from the group consisting of an indazole, a tetrazole, a benzimidazole, a benzoxazole, a thiazole, a triazaindene, a pentaazaindene, a pyrimidine, an imidazole and a pyridine.

8. A method of image formation by silver salt diffusion transfer wherein a photosensitive element which contains an imagewise exposed photosensitive silver halide emulsion layer is developed, in the presence of a silver halide solvent, using an alkaline processing composition, wherein at least a portion of the unexposed silver halide in the emulsion layer is converted to a transferable silver complex salt, and wherein at least a portion of the silver complex salt is transferred into a silver precipitant containing image forming layer to form an image in the image receiving layer wherein a hydroxylamine developing agent is included in the processing composition and at least two stabilizing compounds having two different heterocyclic rings which are represented by the general formula (I) indicated below are included in the silver halide emulsion layer:

(I)

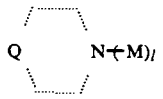

wherein Q represents a group of atoms which is required to form a five or six membered heterocyclic ring M represents a hydrogen atoms, an alkali metal atom, a quaternary ammonium group, or a group such that M becomes a hydrogen atom or an alkali metal atom under alkaline conditions, and l represents 0 or 1, wherein one of the two different heterocyclic rings is a benzotriazole and the other heterocyclic ring is selected from the group consisting of a triazaindene, a tetrazole, a benzimidazole and an indazole.

9. A method of image formation by silver salt diffusion transfer wherein a photosensitive element which contains an imagewise exposed photosensitive silver halide emulsion layer is developed, in the presence of a silver halide solvent, using an alkaline processing composition, wherein at least a portion of the unexposed silver halide in the emulsion layer is converted to a transferable silver complex salt, and wherein at least a portion of the silver complex salt is transferred into a silver precipitant containing image forming layer to form an image in the image receiving layer wherein a hydroxylamine developing agent is included in the processing composition and at least two stabilizing compounds having two different heterocyclic rings which are represented by the general formula (I) indicated below are included in the silver halide emulsion layer:

(I)

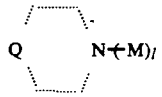

wherein Q represents a group of atoms which is required to form a five or six membered heterocyclic ring M represents a hydrogen atoms, an alkali metal atom, a quaternary ammonium group, or a group such that M becomes a hydrogen atom or an alkali metal atom under alkaline conditions, and l represents 0 or 1, wherein one of the two different heterocyclic rings is selected from the group consisting of a tetraazaindene and a pentaazaindene and the other heterocyclic ring is selected from the group consisting of an indazole, a benzimidazole, a benzoxazole, an imidazole, a tetrazole and a pyrimidine.

* * * * *